US006723012B1

(12) United States Patent
Sutherland

(10) Patent No.: US 6,723,012 B1
(45) Date of Patent: Apr. 20, 2004

(54) POLYMER COMPOSITE BAT

(75) Inventor: Terrance W. Sutherland, Ottawa (CA)

(73) Assignee: CE Composites Baseball, Inc., Ottawa (CA)

( * ) Notice: Subject to any disclaimer, the term of this patent is extended or adjusted under 35 U.S.C. 154(b) by 0 days.

(21) Appl. No.: 10/080,085

(22) Filed: Feb. 21, 2002

(51) Int. Cl.[7] ..... A63B 59/06
(52) U.S. Cl. ..... 473/567; 473/564; 473/566
(58) Field of Search ..... 473/564–568, 473/562, 563, 457, 519, 520

(56) References Cited

U.S. PATENT DOCUMENTS

| | | | | | |
|---|---|---|---|---|---|
| 3,129,003 | A | | 4/1964 | Mueller et al. | 273/72 |
| 3,830,496 | A | * | 8/1974 | Reizer | 473/567 |
| 4,014,542 | A | | 3/1977 | Tanikawa | 273/72 |
| 4,505,479 | A | | 3/1985 | Souders | 273/72 |
| 4,569,521 | A | | 2/1986 | Mueller | 273/72 |
| 4,848,745 | A | | 7/1989 | Bohannan et al. | 273/72 |
| 4,931,247 | A | * | 6/1990 | Yeh | 264/258 |
| 5,114,144 | A | | 5/1992 | Baum | 273/72 |
| 5,301,940 | A | | 4/1994 | Seki et al. | 273/72 |
| 5,303,917 | A | | 4/1994 | Uke | 273/72 |
| 5,364,095 | A | | 11/1994 | Easton et al. | 273/72 |
| 5,395,108 | A | | 3/1995 | Souders et al. | 273/72 |
| 5,407,195 | A | * | 4/1995 | Tiitola et al. | 473/563 |
| 5,458,330 | A | | 10/1995 | Baum | 273/72 |
| 6,139,451 | A | | 10/2000 | Hillerich, III et al. | 473/564 |
| 6,152,840 | A | | 11/2000 | Baum | 473/564 |
| 6,344,007 | B1 | * | 2/2002 | Feeney et al. | 473/567 |
| 6,352,485 | B1 | * | 3/2002 | Philpot et al. | 473/564 |
| 6,425,836 | B1 | * | 7/2002 | Misono et al. | 473/567 |

FOREIGN PATENT DOCUMENTS

JP 406182010 A * 7/1994

OTHER PUBLICATIONS

Publication No. US 2001/0046910 A1, Sutherland, Publication date Nov. 29, 2001.

* cited by examiner

*Primary Examiner*—Mark S. Graham
(74) *Attorney, Agent, or Firm*—Andrus, Sceales, Starke & Sawall, LLP

(57) ABSTRACT

A baseball bat is described having of an elongated cylindrical handle portion for gripping, a cylindrical barrel portion for striking and a tapered cylindrical mid-section connecting the handle portion and the barrel portion, wherein at least the barrel portion is tubular and is constructed solely of a polymer composite material with a three-dimensional fiber reinforcement architecture resulting in improved durability versus conventional polymer composite bats, without any sacrifice in playing performance. Also disclosed are polymer composite baseball bats where the polymer composite material includes between 85% and 100% fiberglass reinforcement fibers, and/or where the central cavity is filled with a damping material such as polymeric foam or a low-density granular material.

35 Claims, 6 Drawing Sheets

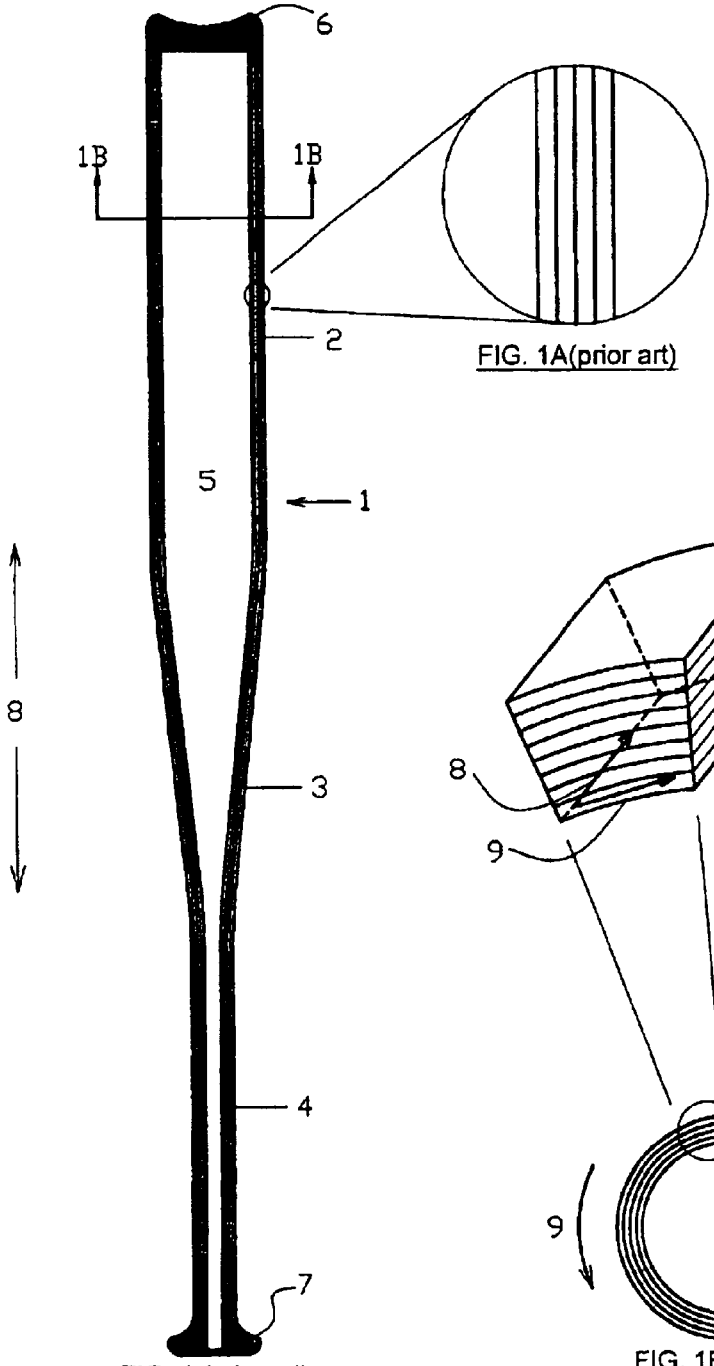
FIG. 1A(prior art)
FIG. 1 (prior art)
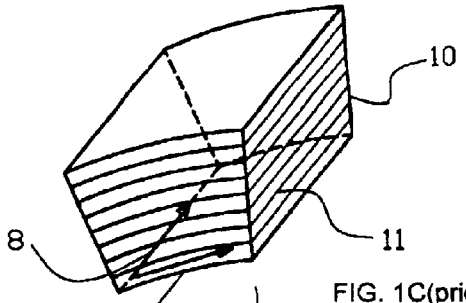
FIG. 1C(prior art)
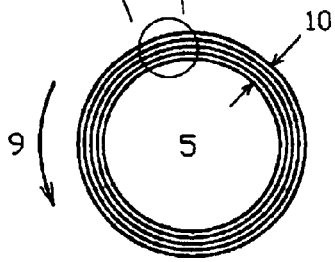
FIG. 1B (prior art)

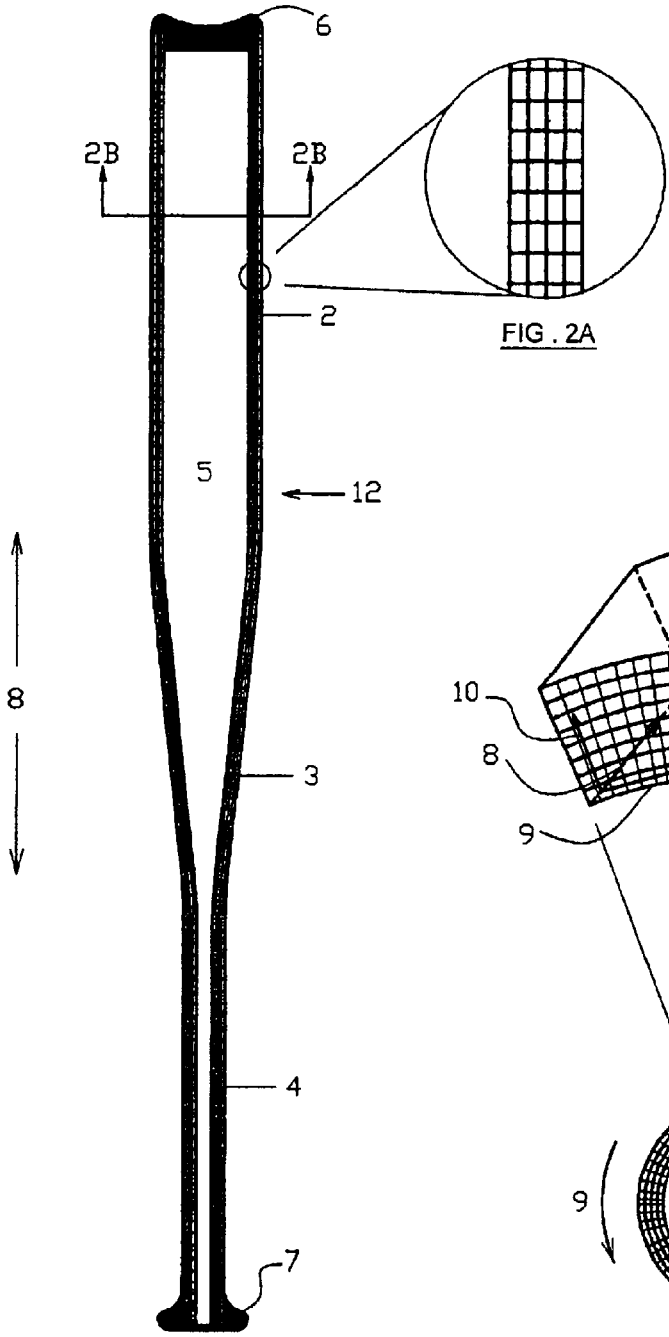
FIG. 2
FIG. 2A
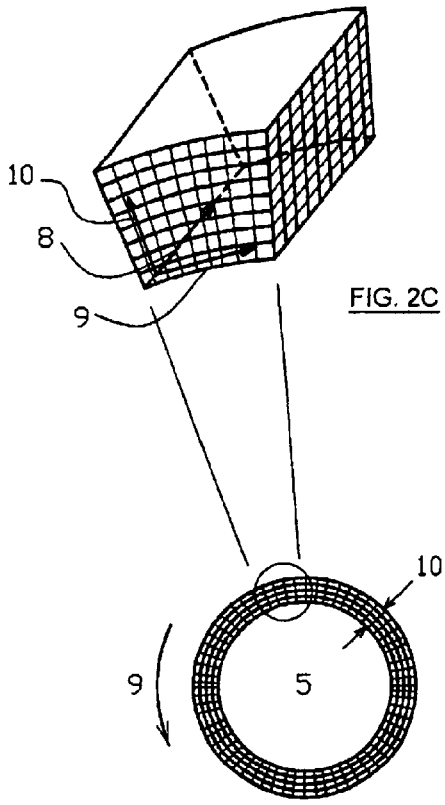
FIG. 2C
FIG. 2B

POLYMER COMPOSITE BAT

FIELD OF THE INVENTION

The present invention relates generally to baseball and softball bats and in particular to such bats wherein at least the striking portion is constructed solely of polymer composite materials having a fiber reinforcement architecture that provides the required durability for a baseball bat, which is subject to repeated ball impacts, while at the same time providing superior or equivalent performance when compared to existing all wood, all metal, all composite, or hybrid material baseball bats.

BACKGROUND OF THE INVENTION

Since the inception of the game of baseball, almost a century ago, manufacturers of baseball bats have continually sought out new materials and designs to make bats both better performing; that is, easier to hit, and/or longer hitting; and more durable; that is, less prone to breakage.

Baseball bats were initially made of wood. Today, wood baseball bats are all made of heavy and strong hardwoods, primarily ash. The rule of thumb for baseball bats made of ash (or other similar hardwoods such as hickory or birch) is that the length in inches equals the weight in ounces. Thus, today's wood baseball bats limit bat speed, and are also prone to catastrophic breakage. Such catastrophic breakage could lead to injury of not only players but also to bystanders and is a real concern to authorities. Also, as wood bats lose moisture and dry out, they lose strength and breakage increases. Replacing broken wood baseball bats is a major cost over the course of a baseball season. For these reasons, today the use of wood baseball bats is restricted mainly to major professional baseball leagues.

More recently, beginning in the mid 1970's, aluminum baseball bats captured a large majority of the market share versus wood bats, even though they are more expensive and players complain about vibrations and the "pinging" sound when a baseball is hit. There are three reasons for the success of aluminum baseball bats: 1) they are lighter than wood bats, thus increasing bat speed and increasing hitting distance; 2) they are locally less stiff than wood bats providing a "trampoline" effect upon ball impact, thus increasing hitting distance; and 3) they are less prone to breakage than wood bats.

Most recently, in an attempt to further lower the weight of aluminum bats and increase the "trampoline" effect, thinner walled and multi-walled aluminum bats have been produced, however, problems have been encountered with balls leaving dents or depressions in the bat and also, bat breakage.

Recently as well, beginning in the late 1980's, hybrid material baseball bats have been produced, incorporating polymer composite materials with both wood and aluminum. The objective of these hybrid bats is to improve either bat performance and/or durability. Such hybrid material baseball bats are described in U.S. Pat. No. 5,364,095 to Easton, U.S. Pat. No. 4,569,521 to Mueller, U.S. Pat. No. 5,395,108 to Souders, and U.S. Published application Ser. No. 20010046910 A1 of Sutherland, all of which disclose means to improve the performance and/or durability of aluminum baseball bats by combining composite-like materials with aluminum. U.S. Pat. No. 6,139,451 to Hillerich, discloses another class of hybrid material baseball bats, which combine traditional ash wood bats reinforced full length with a fiberglass composite material, while earlier U.S. Pat. No. 3,129,003 to Mueller discloses an ash bat reinforced in the handle portion, with a composite-like material.

U.S. Pat. No. 4,014,542 to Tanikawa discloses a five-component hybrid baseball bat having a softwood balsam core, a main member made of foam, a metal tube having apertures for bonding fixed to the barrel portion only of the main member, and an outer layer of glass fiber painted with a synthetic resin.

U.S. Pat. Nos. 5,114,144, 5,458,330, and 6,152,840 to Baum disclose a hybrid multi-component bat having between five and eleven layers. Baum's bat includes external layers of wood veneer over a plurality of resin impregnated fabric socks, which in turn surround inner cores of foam, wood or aluminum which may include cavities.

The foregoing references describe hybrid material baseball bat structures, but do not disclose bats wherein at least the striking portion is constructed solely of polymer composite materials.

U.S. Pat. No. 4,848,745 to Bohannan discloses a two-dimensional filament winding process, which could be used to make an all polymer composite baseball bat, using layers (typical of today's existing composite laminate architecture) of continuous fiber reinforcement in a thermoplastic resin matrix.

U.S. Pat. No. 5,301,940 to Seki discloses a method of manufacturing a bat using a resin injection technique, with the resin being reinforced with layers of fiber.

The above two references concern possible methods for making polymer composite bats without any discussion of the fiber reinforcement architecture to be employed.

U.S. Pat. No. 5,303,917 to Uke discloses a bat comprising two telescoping tubes, made of plastic or plastic with fiber reinforcement, that overlap in the region between handle and barrel.

U.S. Pat. No. 5,395,108 to Souders discloses a synthetic wood composite bat composed of a shell of layers (or plies) of fiber-reinforced resin, a dry fiber tube inside the shell, and a rigid foam filling the shell. Souders specifically describes the existing two-dimensional fiber reinforcement architecture comprising "a plurality of cured layers of fiber resin reinforced material." Such existing fiber reinforcement architecture, as described by Souders, is well known to perform poorly under impact loading situations, as repeatedly encountered by baseball bats. This poor performance is due to inter-laminar (that is, interlayer or inter-ply) failure between the laminates, layers, or plies of polymer composite material. Further, Souders describes an inner dry fiber tube, which is not a polymer composite material.

Moreover, polymer composite baseball bats are typically constructed using a mixture of fiber reinforcement materials such as fiberglass, graphite and aramid. Usually the mix ranges from 67% to 84% by volume of fiberglass combined with from 16% to 33% of other fibers. Generally, the reason for using a mixture of fibers is to achieve a suitable combination of weight, strength, and stiffness. The problem with such fiber reinforcement mixtures is that they tend to suffer from limited durability due to the presence of the stiffer and stronger graphite and aramid fibers, which are less durable under impact loads due to relatively low elongation under impact and relatively poor resin adhesion.

None of the above references describe a polymer composite baseball bat wherein at least the striking portion is constructed solely of polymer composite materials having the laminate architectures or fiber reinforcement techniques required to yield a bat with the necessary combination of thickness (which affects stiffness) and durability, required to ensure the maximum "trampoline" effect, and thus good hitting performance, while at the same time being able to withstand repeated impacts without damage.

A polymer composite material consists of a non-homogenous combination of reinforcement fibers in a polymer resin matrix whereby the resultant polymer composite material has superior properties when compared to either the reinforcement fibers or the polymer resin matrix taken separately. The reinforcement fibers employed in a typical polymer composite material may be graphite (or carbon), aramid (or Kevlar™), fiberglass, or boron, or other suitable fibers, or combinations thereof The polymer resin may be any suitable resin, such as epoxy, vinyl ester, polyester, urethane, nylon, urethane, or other suitable resins, or mixtures thereof.

The following is a specific properties chart showing the density, stiffness and strength properties of various possible materials for use in making baseball bats. All data is taken from standard textbooks available in the field. Specific stiffness and specific strength are actual stiffness and strength divided by density respectively. Strengths for composite materials are given as tensile strength measured along fiber direction in a unidirectional part. Strength for wood is given as the minimum of tensile and compressive ultimate strength. Strength for metal is given as ultimate tensile strength.

| Materials | Density lbs/ft$^3$ | Stiffness M/SI | Specific Stiffness | Strength K/SI | Specific Strength |
|---|---|---|---|---|---|
| Steel AISI 304 | 487 | 30.00 | 3.90 | 85.00 | 10.90 |
| Aluminum 6061-T6 | 169 | 10.00 | 3.70 | 45.00 | 16.60 |
| Aluminum 7075-T6 | 169 | 10.00 | 3.70 | 83.00 | 30.50 |
| Titanium Ti-75A | 283 | 17.00 | 3.70 | 80.00 | 17.70 |
| High Modulus Graphite | 102 | 38.00 | 23.30 | 165.00 | 100.00 |
| Intermediate Modulus Graphite | 102 | 34.00 | 19.50 | 180.00 | 109.80 |
| Commercial Graphite | 98 | 21.00 | 13.30 | 210.00 | 132.90 |
| E-Glass | 130 | 17.00 | 3.10 | 135.00 | 64.30 |
| S-Glass | 124 | 8.00 | 4.00 | 155.00 | 77.60 |
| Kevlar 49 | 86 | 11.00 | 8.00 | 210.00 | 152.20 |
| White Ash | 42 | 2.00 | 3.00 | 8.00 | 12.10 |
| Bigtooth Aspen | 27 | 1.00 | 2.30 | 4.00 | 9.30 |
| Yellow Poplar | 29 | 1.10 | 2.40 | 4.50 | 9.80 |

Polymer composites are over 16 times stronger than ash and 60% stronger than aluminum. However, they are over three times heavier than ash, while approximately 20% lighter than aluminum, the aluminum bats being hollow, therefore lighter than solid composite bats, on an equal volume basis. While a solid all polymer composite baseball bat would be much stronger than either a solid ash or aluminum bat, it would be much too heavy for regular use. However, a tubular all polymer composite bat could be made both stronger and stiffer than a similar tubular aluminum or titanium bat.

In summary, polymer composite materials can theoretically be employed to manufacture baseball bats, wherein at least the striking portion is tubular and made solely of a polymer composite material, which are both stronger and stiffer than today's predominantly all aluminum tubular baseball bats. However, the two dimensional layered fiber architecture used in current polymer composite materials performs poorly under impact loading conditions such as when baseball bats are impacted by baseballs. Thus, the limited attempts, to date, to commercially produce an all polymer composite baseball bat have largely been unsuccessful, primarily due to premature bat failure or breakage. To improve durability, the wall thickness of the polymer composite tube could be increased, however, increasing wall thickness dramatically increases stiffness and weight, which in turn lowers bat performance due a decreased "trampoline" effect as the thicker bat wall springs back less after impacting the ball.

What is needed then, is a baseball bat having at least a tubular striking portion made solely of a polymer composite material with a fiber reinforcement architecture, which can withstand repeated impacts with a baseball, thus providing the required durability, while at the same time having a wall thickness thin enough to ensure hitting performance that is at least equivalent to that of the best currently existing baseball bats.

SUMMARY OF THE INVENTION

In view of the foregoing, an object of one aspect of the present invention is to provide a baseball bat having at least the striking portion made solely of a polymer composite material, which is as durable, or more durable, than conventional baseball bats made of wood, aluminum, hybrid wood/composite, hybrid aluminum/composite, or multi-layer polymer composites.

It is another object of a further aspect of the present invention to provide a baseball bat having at least the striking portion made solely of a polymer composite material, which is of equivalent, or lower weight, than conventional baseball bats made of wood, aluminum, hybrid wood/composite, hybrid aluminum/composite, or multi-layer polymer composites.

It is another object of another aspect of the present invention to provide a baseball bat having at least the striking portion made solely of a polymer composite material, with equivalent, or better, hitting performance as measured by hit distance, than baseball bats made of wood, aluminum, hybrid wood/composite, hybrid aluminum/composite, or multi-layer polymer composites.

It is another object of a still further aspect of the present invention to provide a baseball bat having at least the striking portion made solely of a polymer composite material, with a barrel length or hitting surface equivalent to, or longer than, conventional baseball bats made of wood, aluminum, hybrid wood/composite, hybrid aluminum/composite, or multi-layer polymer composites.

It is another object of a further aspect of the present invention to provide a baseball bat having at least the striking portion made solely of a polymer composite material, and having a structure, which improves damping so as to minimize vibrations on the hands of the user.

According to one aspect then, the bat of the present invention comprises a continuous all polymer composite tubular body having a handle portion for gripping, a barrel portion for striking, impacting, or hitting, and a tapered mid-section connecting the handle portion and the barrel portion. The fiber reinforcement architecture of the present invention includes reinforcement fibers oriented across two dimensions, in multi-directions within cylindrical planes, or layers, plys, or laminates, existing between the inner and outer diameters of the tubular bat, plus reinforcement fibers oriented in a third dimension intersecting the cylindrical planes through the thickness of the all polymer composite baseball bat.

According to another aspect of the present invention, there is provided a baseball bat, having a length and a circumference, comprising a cylindrical handle portion for gripping; a cylindrical tubular barrel portion for striking, the barrel portion having a barrel wall thickness; and a tapered cylindrical mid-section connecting the handle portion and the barrel portion, the barrel portion being constructed solely of a polymer composite material, the polymer composite material comprising a resin and reinforcement fibers, the reinforcement fibers oriented on at least one cylindrical plane defined by the length and the circumference, and the reinforcement fibers further oriented to intersect the at least one cylindrical plane through the barrel wall thickness.

According to yet another aspect of the present invention, there is provided a baseball bat, having a length, and a circumference, comprising a cylindrical handle portion for gripping; a cylindrical tubular barrel portion for striking; and a tapered cylindrical mid-section connecting the handle portion and the barrel portion, the barrel portion being constructed solely of a polymer composite material, the polymer composite material comprising a resin and reinforcement fibers, and the reinforcement fibers comprising at least one three-dimensional fiber form.

According to a further aspect of the present invention, there is provided a baseball bat, having a length, and a circumference, comprising a cylindrical handle portion for gripping; a cylindrical tubular barrel portion for striking; and a tapered cylindrical mid-section connecting the handle portion and the barrel portion, the barrel portion being constructed solely of a polymer composite material, the polymer composite material comprising a resin and reinforcement fibers, and the reinforcement fibers comprised of at least between 85% and 100% fiberglass fibers.

According to another aspect of the present invention, there is provided a baseball bat, having a length, and a circumference, comprising a cylindrical handle portion for gripping; a cylindrical tubular barrel portion for striking; and a tapered cylindrical mid-section connecting the handle portion and the barrel portion, the barrel portion being constructed solely of a polymer composite material, the polymer composite material comprising a resin and reinforcement fibers, and the barrel portion having a central cavity containing a damping material.

According to a still further aspect of the present invention, there is provided a tubular baseball bat, having a length, a circumference, a thickness, and a central cavity, comprising a cylindrical handle portion for gripping, a cylindrical barrel portion for striking, and a tapered cylindrical mid-section connecting the handle portion and the barrel portion, the handle portion, the barrel portion and the tapered mid-section being constructed solely of a polymer composite material, the polymer composite material comprising a resin and reinforcement fibers, the reinforcement fibers oriented on at least one cylindrical plane defined by the length and the circumference, and the reinforcement fibers further oriented to intersect the at least one cylindrical plane through the thickness of the bat.

According to another aspect of the present invention, there is provided a tubular baseball bat, having a length, a circumference, a thickness, and a central cavity, comprising a cylindrical handle portion for gripping, a cylindrical barrel portion for striking, and a tapered cylindrical mid-section connecting the handle portion and the barrel portion, the handle portion, the barrel portion and the tapered mid-section being constructed solely of a polymer composite material, the polymer composite material comprising a resin and reinforcement fibers, and the reinforcement fibers comprising at least one three-dimensional fiber form.

Advantageously, baseball bats made in accordance with preferred aspects of the present invention are equivalent or lower in weight and are as durable or more durable, than conventional baseball bats made of wood, aluminum, hybrid wood/composite, hybrid aluminum/composite, or multi-layer polymer composites. The bats of the present invention, provide equivalent or better, hitting performance as measured by hit distance, and permit the construction of bats having equivalent or longer barrel lengths or hitting surfaces than such conventional bats. Further, bats of the present invention can be constructed with a structure, which improves damping so as to minimize vibrations on the hands of the user.

BRIEF DESCRIPTION OF THE DRAWINGS

The present invention will be further understood from the following description with reference to the drawings in which:

FIG. 1 is a longitudinal cross-section of a typical all polymer composite baseball bat of the prior art.

FIG. 1A is an enlargement of a section of FIG. 1 showing the typical two-dimensional multi-layer fiber reinforcement architecture employed in the prior art.

FIG. 1B is a horizontal cross-section of the typical multi-layer polymer composite baseball bat of the prior art shown in FIG. 1.

FIG. 1C is a three-dimensional enlargement of a section of FIG. 1B, showing the typical two-dimensional multi-layer fiber reinforcement architecture employed in the prior art.

FIG. 2 is a longitudinal cross-section of one embodiment of the baseball bat of the present invention, having a tubular handle, a tubular tapered mid-section, and a tubular striking or barrel portion constructed solely of a polymer composite material.

FIG. 2A is an enlargement of a section of FIG. 2, showing the three-dimensional fiber reinforcement architecture of one embodiment of the present invention.

FIG. 2B is a horizontal cross-section of the barrel portion of the baseball bat shown in FIG. 2.

FIG. 2C is a three-dimensional enlargement of a section of FIG. 2B, showing the three-dimensional fiber reinforcement architecture employed in accordance with one embodiment of the present invention.

DETAILED DESCRIPTION OF THE INVENTION

Figures 3, 3A, 3B:
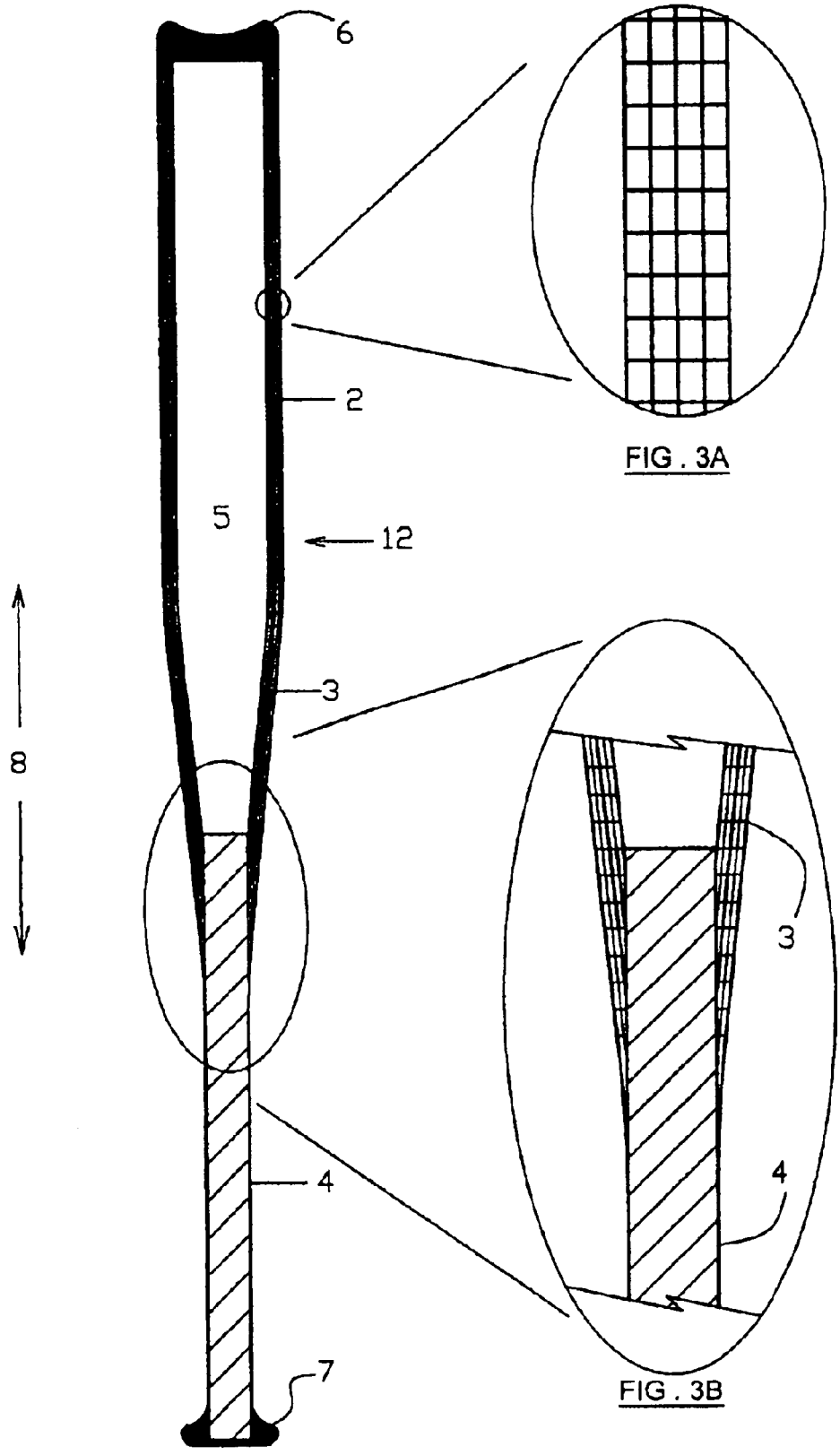
FIG. 3 is a longitudinal cross-section of a further embodiment of the baseball bat of the present invention, having a solid handle portion.
FIG. 3A is an enlargement of a section of FIG. 3, showing the three-dimensional fiber reinforcement architecture in the barrel portion.
FIG. 3B is an enlargement of a section of FIG. 3, in the area where the solid handle joins the tapered tubular mid-section.

FIG. 1, shows a tubular all polymer composite baseball bat typical of the prior art, having a bat body 1.

FIG. 2, illustrates one embodiment of the baseball bat of the present invention, having a tubular bat body 12 constructed solely of a polymer composite material.

The bats shown in FIGS. 1 and 2, each have a handle portion 4 for gripping, a barrel or striking portion 2 for striking, impacting, or hitting, and a tapered mid-section 3, connecting handle portion 4 with barrel portion 2. A conventional endcap 6 and knob 7, constructed of any materials, are located at the ends of barrel 2 and handle 4, respectively. The interiors 5 of bat bodies 1 and 12 are hollow.

In one preferred embodiment of the present invention, as discussed in further detail below, but not shown in the drawings, interior 5 could, alternatively, be filled partially or entirely with foam or a low-density granular material.

In further preferred embodiments of the present invention, as shown in FIGS. 3, 4, 5, and 6, handle portion 4 and/or mid-section 3 can be solid or tubular and can be made from a polymer composite material, or from other materials such as wood, metal, aluminum, plastic, foam, composite, or other suitable materials.

FIG. 1A is an enlargement of a section of FIG. 1 showing the typical two-dimensional multi-layer fiber reinforcement architecture employed in the polymer composite materials of the prior art. FIG. 2A is an enlargement of a section of FIG. 2, showing the three-dimensional fiber reinforcement architecture of the polymer composite material of the present invention.

FIG. 1B is a cross-sectional view along lines 1B of FIG. 1, and FIG. 2B is a cross-sectional view along lines 2B of FIG. 2.

Bat bodies 1 and 12 have a length 8, a circumference 9, which varies in diameter along length 8, and a wall thickness 10, which may vary along length 8.

FIG. 1C is a three-dimensional enlargement of a section of FIG. 1B, showing the typical two-dimensional multi-layer fiber reinforcement architecture employed in the polymer composite materials of the prior art. FIG. 2C is a three-dimensional enlargement of a section of FIG. 2B, showing the three-dimensional fiber reinforcement architecture employed in accordance with the present invention.

The bats illustrated in FIGS. 1 to 6 are three-dimensional and have physical properties such as strength, stiffness and durability (toughness). These characteristics are important considerations in all three dimensions, along length 8, around circumference 9, and through thickness 10.

While a polymer composite baseball bat is three-dimensional, the reinforcement fibers, which largely determine the bat's physical properties, are supplied in their raw material form as continuous filaments or strands, which are grouped together and made available in a bundled form. These one-dimensional fiber bundles, known as yarns, tows, or rovings, have maximum physical properties along their length, and are placed along the length 8 or around circumference 9 of the bat. Commonly, reinforcement fibers are made into flat sheets, or broad goods, with the fibers arranged and held in two-dimensions by a knitting, braiding, or weaving processes. These two-dimensional reinforcement fibers are positioned in cylindrical planes covering both length 8 and circumference 9 of the bat. The length direction (0 degrees) is referred to as the warp direction while the width direction or circumference (90 degrees) is referred to as the weft direction. Fibers can be arranged all oriented in the warp direction at 0 degrees, all in the weft direction at 90 degrees, in both the warp and weft directions at 0 and 90 degrees, or at various angles to each other, such as +45 degrees and −45 degrees, etc. The typical tubular all polymer composite baseball bat, as shown in FIG. 1, and in particular in FIGS. 1A, 1B, and 1C, is made by layering one or two-dimensional reinforcement fibers to achieve the required thickness 10. Consequently, such polymer composite products are often called laminates.

Typically, ten to thirty individual layers or laminates, positioned in cylindrical planes defined by length 8 and circumference 9, are used for existing tubular all polymer composite bats. Since the fiber reinforcements within the layers have much higher physical properties (such as strength) than the polymer matrix, the baseball bat properties in cylindrical planes along length 8 and around circumference 9, are much greater than the physical properties through thickness 10. Thus, at a typical laminate boundary 11, as shown in FIG. 1C, between the layers, also known as the inter-laminar interface, the bat's physical properties are largely determined by the properties of the much weaker polymer resin matrix. For this reason, under impact loading, such as that which occurs in a bat-ball collision, bats having at least the striking portion 2 constructed solely of a polymer composite material, typically fail interlaminarly (that is, between the laminate layers), at a typical laminate boundary 11, and typically at much lower physical property (strength) levels than those of the fiber reinforcements. Consequently, the relatively few bat designs attempted to date, having at least the striking portion constructed solely of a polymer composite material, have not been commercially successful due to a lack of durability and premature failure resulting from the use of a two-dimensional fiber reinforcement architecture. In some cases, in an attempt to compensate for the lack of strength under impact loading, the wall thickness 10 of the bats has been increased. Such bats have suffered from poor performance due to increased weight and high stiffness resulting in little or no "trampoline" effect.

To solve these problems, the bat body 12 of the present invention, incorporates a three-dimensional fiber reinforcement architecture at least in the barrel or striking portion 2, which includes, in addition to fiber reinforcement placed on cylindrical planes defined by length 8, and circumference 9, fiber reinforcements that intersect the cylindrical planes of bat body 12, through thickness 10. The result is a bat 12, having at least the tubular barrel or striking portion 2 constructed solely of a polymer composite material, and having improved durability and increased hitting performance, due to its thinner-walled construction, and relatively low weight compared to similar conventional polymer composite bats using a two-dimensional fiber reinforcement architecture. The wall thickness 10 of bats made using the three-dimensional fiber reinforcement architecture of the present invention, at least in the striking portion 2, is normally less than or equal to 0.25 inches. The resulting reduced weight of the bats of the present invention can be used to design longer barrel portions 2, having larger sweet spots.

Figures 4, 4A, 4B:
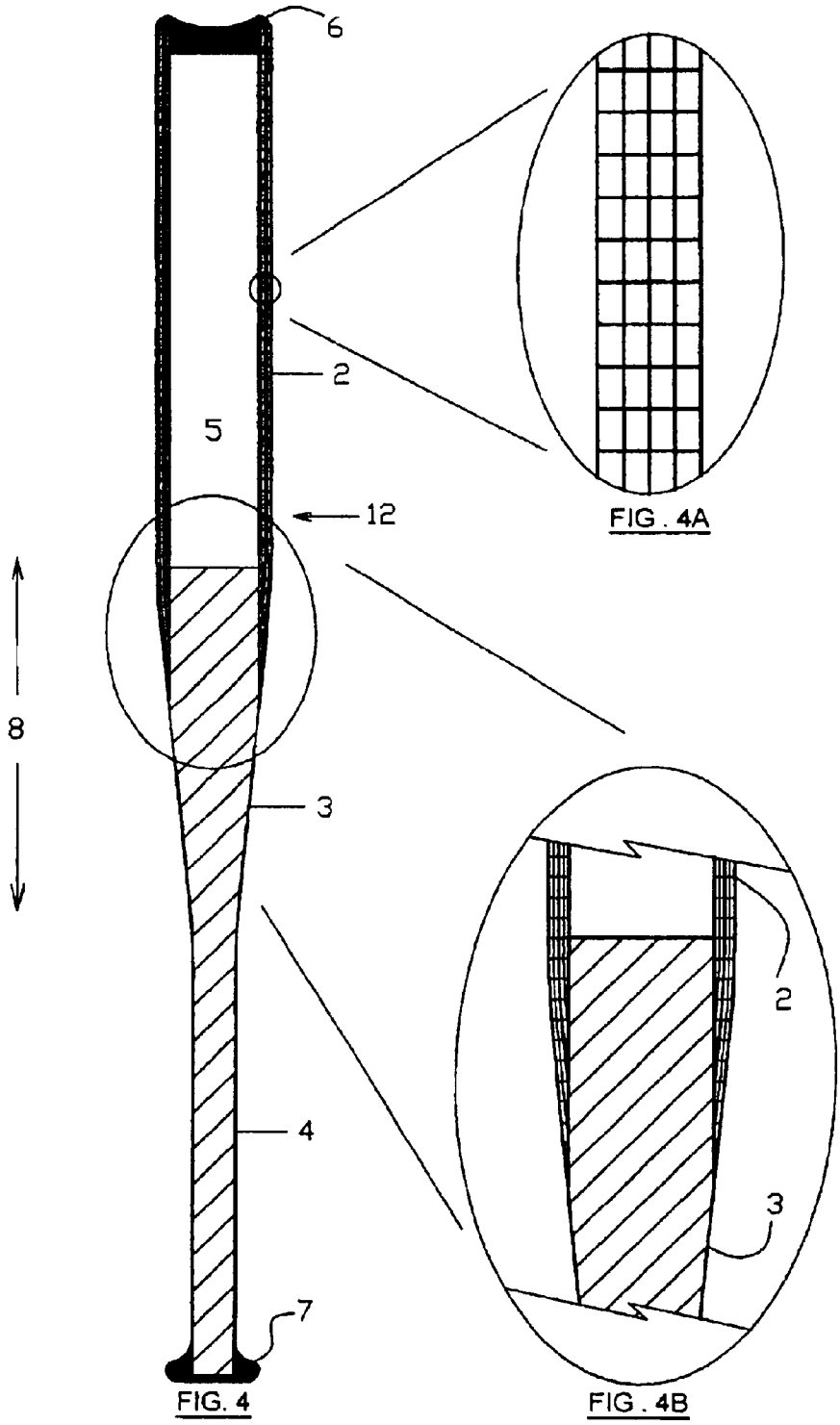
FIG. 4 is a longitudinal cross-section of a further embodiment of the baseball bat of the present invention, having a solid handle portion and a solid tapered mid-section.
FIG. 4A is an enlargement of a section of FIG. 4, showing the three-dimensional fiber reinforcement architecture in the barrel portion.
FIG. 4B is an enlargement of a section of FIG. 4, in the area where the solid mid-section joins the tubular barrel portion.
Figures 5, 5A, 5B:
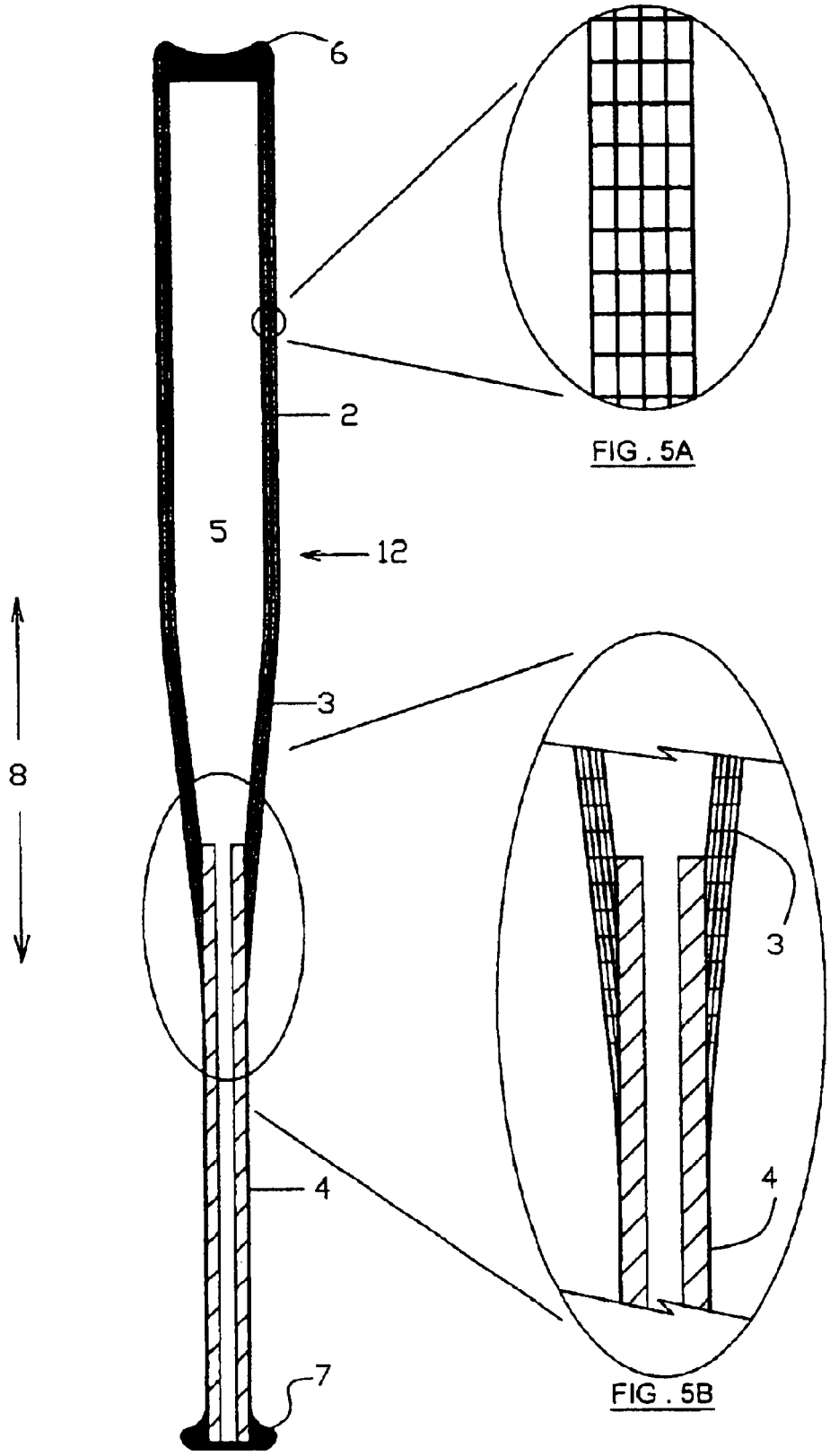
FIG. 5 is a longitudinal cross-section of a further embodiment of the baseball bat of the present invention, having a tubular handle made of a different material than the tapered mid-section and the barrel portion.
FIG. 5A is an enlargement of a section of FIG. 5, showing the three-dimensional fiber reinforcement architecture in the barrel portion.
FIG. 5B is an enlargement of a section of FIG. 5, in the area where the handle joins the tapered mid-section.
Figures 6, 6A, 6B:
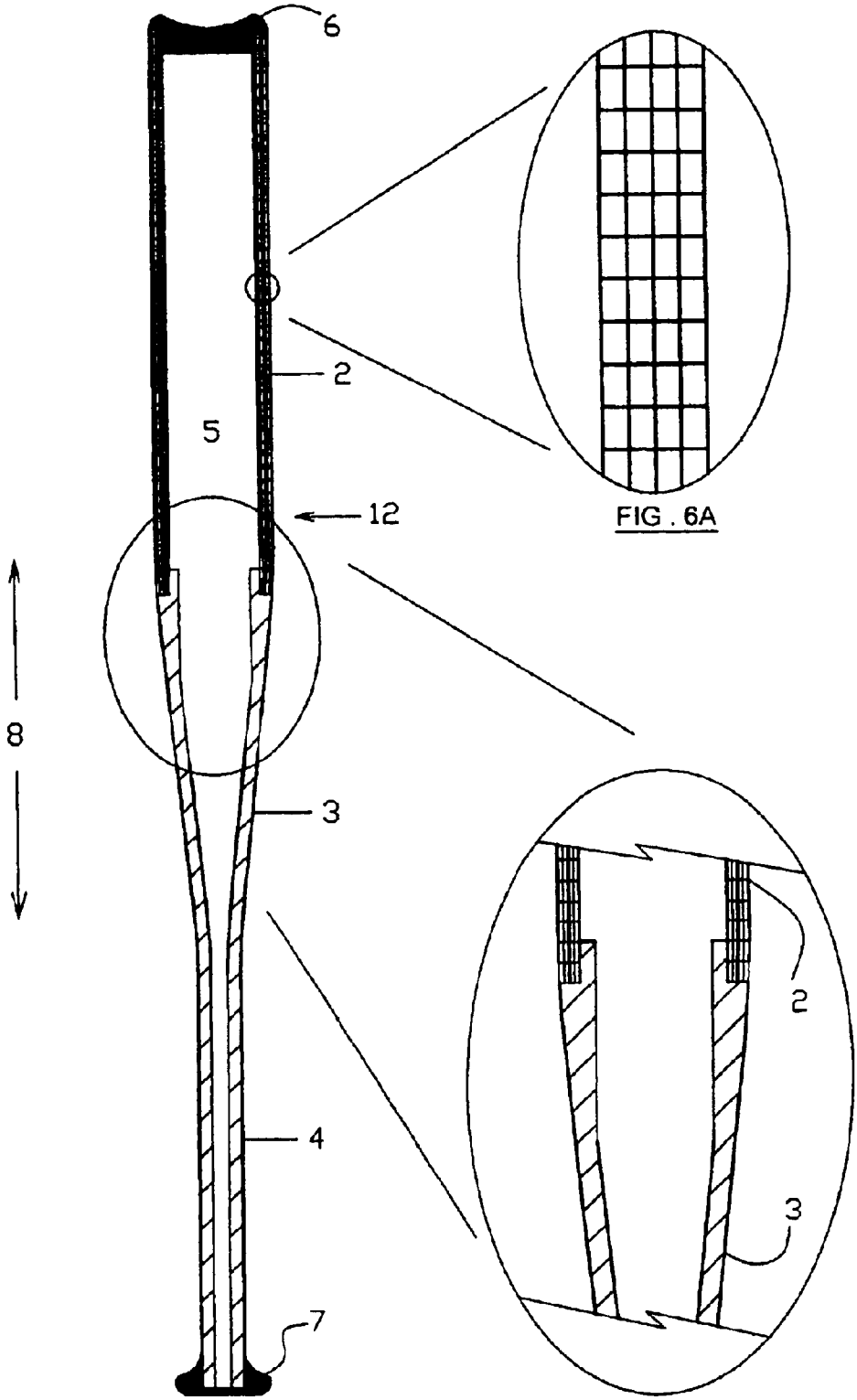
FIG. 6 is a longitudinal cross-section of a further embodiment of the baseball bat of the present invention, having a tubular handle portion and a tubular tapered mid-section made of different material than the barrel portion.
FIG. 6A is an enlargement of a section of FIG. 6, showing the three-dimensional fiber reinforcement architecture in the barrel portion.
FIG. 6B is an enlargement of a section of FIG. 6, in the area where the tubular mid-section joins the tubular barrel portion.

As illustrated in FIG. 2, it is preferable that the entire bat body 12 be tubular and constructed solely of a polymer composite material using the three-dimensional fiber reinforcement architecture described above, however, the advantages of the present invention are also realized if only the barrel or striking portion 2 is tubular and constructed solely of a polymer composite material using the three-dimensional fiber reinforcements described herein. In this case, as shown in FIGS. 3 to 6, handle portion 4 and/or tapered mid-section 3 can be tubular or solid and can be made from polymer composite materials or other materials such as wood, metal, aluminum, plastic, foam, composite, or other suitable materials. For example, FIG. 3 shows bat body 12 having a solid handle portion 4 made of a different material than the remainder of the bat, FIG. 4 shows bat body 12 having a solid handle portion 4 and a solid tapered mid-section 3 made of different materials than barrel portion 2, FIG. 5 shows bat body 12 having a tubular handle portion 4 made of different material than the remainder of the bat, and FIG. 6 shows bat body 12 having a tubular handle portion 4 and a tubular tapered mid-section 3 made of different materials than barrel portion 2.

The use of a fiber reinforcement architecture that incorporates three-dimensional fiber forms at least in the tubular all polymer composite barrel portion 2 of bat body 12, significantly improves durability while maintaining, or improving performance. The applicant has utilized several types of three-dimensional fiber reinforcements in constructing the polymer composite bats of the present invention. These include random chopped strand mats, formed by chopping roving, yarn or tow into short lengths and pressing them together into thick layers with fibers randomly arranged in all directions, and continuous strand mat where the fibers are not chopped but instead are laid down by randomly swirling the fibers. Included as well, are three-dimensional fiber forms made by weaving, knitting, stitching, or braiding continuous fibers in a third vertical (thickness) direction. In making such three-dimensional broad goods, multiple layers of two-dimensional fabric, which are produced at the same time in parallel sheets, are simultaneously interlaced with fiber bundles or roving in the perpendicular or thickness direction. Because fiber bundles have maximum physical properties along the length of the fibers, the use of such three-dimensional broad goods and/or random chopped or continuous strand mats in the present invention, greatly reduces the typical weaknesses found at the inter-laminar boundaries 11, under impact loading, resulting in a much stronger and more durable all polymer composite tubular baseball bat 12 than was previously possible.

Advantageously, at least in the barrel portion 2, a single layer of three-dimensional fabric is used in a polymer resin matrix. This results in zero inter-laminar boundaries 11 and eliminates the problem of inter-laminar failure. A single layer of three-dimensional fiber reinforcement fabric provides the best combination of low weight, high strength, increased durability and reduced thickness. For a number of reasons, it may not be possible to use a single layer of three-dimensional fiber reinforcement. For example, the required wall thickness 10 may be greater than the thickness of available three-dimensional fabric. In these situations, multiple layers of three-dimensional fiber reinforcement can be used. However, because of the increased thickness of three-dimensional fiber forms, and their increased strength in the thickness direction compared with two-dimensional fiber materials, the number of layers required to achieve the same strength and durability is greatly reduced. The fewer number of layers and increased strength in the thickness direction greatly lessens the likelihood of inter-laminar failure and reduces the weight and thickness of the resulting bat.

To further reduce the likelihood of inter-laminar failure in a bat having multiple layers of three-dimensional fiber reinforcement, the applicant has found it advantageous to alternate the type of three-dimensional fiber from layer to layer. For example, a layer of three-dimensional random chopped or continuous strand mat can be used to separate layers of a three-dimensional broad good such as a woven fabric. The multi directional fibers of the random chopped or continuous strand mat reduces the likelihood of inter-laminar failure by interconnecting and binding together the two layers of woven fabric through the polymer resin matrix. Other combinations of knitted, woven, braided or stitched three-dimensional fibers offer similar advantages. Moreover, alternating layers of three-dimensional random chopped or continuous strand mat, with layers of two-dimensional reinforcement fibers will similarly reduce the likelihood of inter-laminar failure inherent in two-dimensional fiber reinforcement material.

Generally, the fiber reinforcement materials used in making polymer composite bats in accordance with the present invention are selected from a group consisting of fiberglass, graphite, aramid, and boron or other suitable fibers, or mixtures of any of these.

The polymer resin matrix used to bind the reinforcement fibers may be any suitable resin, such as epoxy, vinyl ester, polyester, urethane, nylon, urethane, or other suitable resins, or mixtures thereof The polymer resin may be left to retain its natural color, or a color pigment may be added to the resin to result in bats of any desired color.

In addition to the above, the applicant has found that fiberglass has two important characteristics not present in other reinforcement fibers typically used to make baseball bats wherein at least the barrel portion 2 is tubular and made solely of a polymer composite material. These characteristics are significant in determining baseball bat toughness, impact resistance, and durability regardless of whether one- two- or three-dimensional fiber reinforcements are used. First, adhesion of the polymer matrix to the fiberglass fibers is significantly greater than the adhesion to other fiber candidates. Second, the elongation properties of fiberglass are far greater than those of other fibers, such as graphite, used in making existing all polymer composite bats. The greater elongation properties of fiberglass allow it to stretch without failure under impact loading. Thus, a bat having at least the barrel portion 2 made solely of a tubular polymer composite material composed of a higher percentage of fiberglass reinforcement fibers in a polymer resin matrix, results in a bat with increased durability relative to a similar bat having a lower percentage of fiberglass reinforcement fibers. The applicant has found that the greatest advantage from using fiberglass occurs when the percentage of fiberglass reinforcement fibers versus other fibers is between 85% and 100%. Ideally, having 100% fiberglass reinforcement fibers in a polymer matrix will have the greatest durability, toughness and impact resistance.

Polymer composite materials are known to have superior damping properties relative to metals. Thus, bats of the present invention vibrate less and result in less stinging of the user's hands.

Further, as shown in FIGS. 2 to 6, tubular sections of the bats of the present invention have an internal cavity 5, that can be filled with a suitable damping material, such as a polymeric foam or low-density granular materials, or other suitable materials, in at least barrel portion 2, but also in tapered mid-section 3, or handle portion 4, or combinations thereof Filling cavity 5, or parts thereof, with foam can be used to selectively weight the bat, and/or produce a differentiated more pleasing sound relative to the metallic pinging of an aluminum bat, and/or reduce vibrations providing less sting in the user's hands, and/or lower the trampoline effect, or hitting performance, if required by regulations. As shown in FIGS. 3 and 4, handle portion 4 and/or tapered mid-section 3 may be solid so that only the internal cavity 5 of barrel portion 2 is filled with damping material.

Moreover, filling cavity 5, or parts thereof, with a damping material such as polymeric foam or the like, creates a "structural sandwich" comprised of a thin, high strength, high stiffness external polymer composite sleeve or skin covering and bonded to a relatively thick, relatively weak lightweight foam core. The combination provides lightweight bats with high strength and stiffness and improved durability. In the case of the "structural sandwich" construction, the external all polymer composite sleeve or skin is constructed around the foam core, ensuring bonding of the polymer skin to the foam core. In the alternative, the foam core can be coated with resin and inserted into the previously constructed all polymer composite tube.

The types of polymeric foam used to fill cavity 5 include polystyrene, polyurethane, polyvinyl, polymethacrylimide, polyamide, syntactic, styreneacrylonitrile, polyolefin, or other similar foams, or combinations thereof Typical foam densities range from approximately 3 $lbs/ft^3$ to 20 $lbs/ft^3$.

Bats of the present invention can be lower in weight than wood, metal, or hybrid metal bats. Lower weight results in faster bat speed, which in turn increases performance (hitting distance) and also allows a player more time before reacting to a pitched ball. A three-mile per hour (mph) increase in bat speed results in approximately 10 feet of additional hitting distance. Also, the increase in bat speed allows a player 3% more reaction time. This equals approximately 2 feet more of pitch length before the decision to swing or not must be made. The result is a further increase in performance, resulting in a better hitting average. Where the minimum weight of a bat is regulated, the lower weight properties of the all polymer composite bats of the present invention can be used to lengthen the hitting area, that is barrel portion 2, and thus increasing the sweet spot, relative to conventional bats. This allows increased opportunity for the player to optimally contact the ball, which further increases performance and hitting average.

Also, lower weight bats of the present invention can have secondary weights added evenly to both ends (balanced load) or at either end (end loaded), which can further improve performance and hitting distance.

Bats of the present invention may be manufactured by a variety of polymer composite processes including resin transfer molding, compression molding, hand lay-up, filament winding, and other processes known within the industry. The hollow tubular all polymer composite portions of the bats of the present invention are typically formed around a solid mandrel or tool, which is subsequently withdrawn, extracted, or dissolved. In the embodiment where cavity 5 includes a damping material such as polymeric foam, to form a "structural sandwich", the foam core may serve as the mandrel and remain as part of the finished bat.

The invention may be embodied in other specific forms without departing from the spirit or essential characteristics thereof The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

I claim:

1. A baseball bat, having a length and a circumference, comprising:

a cylindrical handle portion for gripping;

a cylindrical tubular barrel portion for striking, said barrel portion having a barrel wall thickness; and a tapered cylindrical mid-section connecting said handle portion and said barrel portion, said barrel portion being constructed solely of a polymer composite material, said polymer composite material comprising a resin and reinforcement fibers, said reinforcement fibers oriented on at least one cylindrical plane defined by said length and said circumference, and said reinforcement fibers further oriented to intersect said at least one cylindrical plane through said barrel wall thickness, wherein said reinforcement fibers are selected from the group of three-dimensional fiber forms consisting of chopped strand mat, continuous strand mat, three-dimensional woven fabric, three-dimensional knitted fabric, three-dimensional stitched fabric, three-dimensional braided fabric, and combinations thereof.

2. The baseball bat of claim 1, wherein said reinforcement fibers are selected from the group consisting of fiberglass, graphite, aramid, boron, and mixtures thereof, and said resin is selected from the group of resins consisting of epoxy, vinyl ester, polyester, urethane, nylon, urethane, and mixtures thereof.

3. The baseball bat of claim 1, wherein said reinforcement fibers are comprised of at least between 85% and 100% fiberglass fibers.

4. The baseball bat of claim 1, wherein said barrel portion has a central cavity containing a damping material.

5. The baseball bat of claim 4, wherein said damping material is a polymeric foam or a low-density granular material.

6. The baseball bat of claim 1, wherein said barrel wall thickness is less than or equal to 0.25 inches.

7. The baseball bat of claim 1, wherein said resin includes a colored pigment.

8. A baseball bat, having a length, and a circumference, comprising:

a cylindrical handle portion for gripping;

a cylindrical tubular barrel portion for striking; and a tapered cylindrical mid-section connecting said handle portion and said barrel portion, said barrel portion being constructed solely of a polymer composite material, said polymer composite material comprising a resin and reinforcement fibers, and said reinforcement fibers comprising at least one three-dimensional fiber form, wherein said at least one three-dimensional fiber form is selected from the group of three-dimensional fiber forms consisting of chopped strand mat, continuous strand mat, three-dimensional woven fabric, three-dimensional knitted fabric, three-dimensional stitched fabric, three-dimensional braided fabric, and combinations thereof.

9. The baseball bat of claim 8, wherein said reinforcement fibers are selected from the group consisting of fiberglass, graphite, aramid, boron, and mixtures thereof, and said resin is selected from the group of resins consisting of epoxy, vinyl ester, polyester, urethane, nylon, urethane, and mixtures thereof.

10. The baseball bat of claim 8, wherein said reinforcement fibers are comprised of at least between 85% and 100% fiberglass fibers.

11. The baseball bat of claim 8, wherein said barrel portion has a central cavity containing a damping material.

12. The baseball bat of claim 11, wherein said damping material is a polymeric foam or a low-density granular material.

13. The baseball bat of claim 8, wherein said barrel portion has a barrel wall thickness less than or equal to 0.25 inches.

14. The baseball bat of claim 8, wherein said resin includes a colored pigment.

15. A baseball bat, having a length, and a circumference, comprising:

a cylindrical handle portion for gripping;

a cylindrical tubular barrel portion for striking; and a tapered cylindrical mid-section connecting said handle portion and said barrel portion, said barrel portion being constructed solely of a polymer composite material, said polymer composite material comprising a resin and reinforcement fibers, and said reinforcement fibers comprised of at least between 85% and 100% fiberglass fibers, wherein said reinforcement fibers are selected from the group of reinforcement fibers consisting of:

three-dimensional chopped strand mat or continuous strand mat, three-dimensional woven, knitted, stitched, or braided fabric, and combinations thereof.

16. The baseball bat of claim 15, wherein said resin is selected from the group of resins consisting of epoxy, vinyl ester, polyester, urethane, nylon, urethane, or mixtures thereof.

17. The baseball bat of claim 15, wherein said barrel portion includes a central cavity containing a damping material.

18. The baseball bat of claim 17, wherein said damping material is a polymeric foam or a low-density granular material.

19. The baseball bat of claim 15, wherein said barrel portion has a barrel wall thickness less than or equal to 0.25 inches.

20. The baseball bat of claim 15, wherein said resin includes a colored pigment.

21. A baseball bat, having a length, and a circumference, comprising:

a cylindrical handle portion for gripping;

a cylindrical tubular barrel portion for striking; and a tapered cylindrical mid-section connecting said handle portion and said barrel portion, said barrel portion being constructed solely of a polymer composite material, said polymer composite material comprising a resin and reinforcement fibers, and said barrel portion having a central cavity containing a damping material, wherein said reinforcement fibers are oriented on two or more concentric cylindrical planes defined by said length and said circumference, and wherein alternate ones of said two or more concentrically oriented cylindrical planes of said reinforcement fibers are selected from the group of three-dimensional fiber forms consisting of chopped strand mat and continuous strand mat, or mixtures thereof.

22. The baseball bat of claim 21, wherein said damping material is a polymeric foam or a low-density granular material.

23. The baseball bat of claim 22, wherein said foam is selected from the group consisting of polystyrene, polyurethane, polyvinyl, polymethacrylimide, polyamide, syntactic, styreneacrylonitrile, polyolefin, and wherein said foam has a density in a range from 3 $lbs/ft^3$ to 20 $lbs/ft^3$.

24. The baseball bat of claim 21, wherein said reinforcement fibers are selected from the group consisting of fiberglass, graphite, aramid, boron, and mixtures thereof, and said resin is selected from the group consisting of epoxy, vinyl ester, polyester, urethane, nylon, urethane, and mixtures thereof.

25. The baseball bat of claim 21, wherein said reinforcement fibers are comprised of at least between 85% and 100% fiberglass fibers.

26. The baseball bat of claim 21, wherein said reinforcement fibers are selected from the group of reinforcement fibers consisting of:

one-dimensional yarn, tow or roving, two-dimensional knitted, woven or braided fabric, three-dimensional chopped strand mat or continuous strand mat, three-dimensional woven, knitted, stitched, or braided fabric, and combinations thereof.

27. The baseball bat of claim 21, wherein said barrel portion has a wall thickness less than or equal to 0.25 inches.

28. The baseball bat of claim 21, wherein said resin includes a colored pigment.

29. A tubular baseball bat, having a length, a circumference, a wall thickness and a central cavity, comprising:

a cylindrical handle portion for gripping;

a cylindrical barrel portion for striking; and a tapered cylindrical mid-section connecting said handle portion and said barrel portion, said handle portion, said barrel portion and said tapered mid-section being constructed solely of a polymer composite material, said polymer composite material comprising a resin and reinforcement fibers, said reinforcement fibers oriented on at least one cylindrical plane defined by said length and said circumference, and said reinforcement fibers further oriented to intersect said at least one cylindrical plane through the wall thickness of the bat, wherein said reinforcement fibers are selected from the group of three-dimensional fiber forms consisting of chopped strand mat, continuous strand mat, three-dimensional woven fabric, three-dimensional knitted fabric, three-dimensional stitched fabric, three-dimensional braided fabric, and combinations thereof.

30. A tubular baseball bat, having a length, a circumference, a wall thickness and a central cavity, comprising:

a cylindrical handle portion for gripping;

a cylindrical barrel portion for striking; and a tapered cylindrical mid-section connecting said handle portion and said barrel portion, said handle portion, said barrel portion, and said tapered mid-section being constructed solely of a polymer composite material, said polymer composite material comprising a resin and reinforcement fibers, and said reinforcement fibers comprising at least one three-dimensional fiber form, wherein said at least one three-dimensional fiber form is selected from the group of three-dimensional fiber forms consisting of chopped strand mat, continuous strand mat, three-dimensional woven fabric, three-dimensional knitted fabric, three-dimensional stitched fabric, three-dimensional braided fabric, and combinations thereof.

31. A baseball bat, having a length and a circumference, comprising:

a cylindrical handle portion for gripping;

a cylindrical tubular barrel portion for striking, said barrel portion having a barrel wall thickness; and, a tapered cylindrical mid-section connecting said handle portion and said barrel portion, said barrel portion being constructed solely of a polymer composite material, said polymer composite material comprising a resin and reinforcement fibers, said reinforcement fibers oriented on at least two concentric cylindrical planes defined by said length and said circumference, said reinforcement fibers in alternate ones of said at least two concentric cylindrical planes further oriented to intersect said corresponding cylindrical plane through said barrel wall thickness, wherein said alternate ones of said at least two concentrically oriented cylindrical planes of said reinforcement fibers are selected from the group of three-dimensional fiber forms consisting of chopped strand mat and continuous strand mat, or mixtures thereof.

32. A baseball bat, having a length, and a circumference, comprising:

a cylindrical handle portion for gripping;

a cylindrical tubular barrel portion for striking; and, a tapered cylindrical mid-section connecting said handle portion and said barrel portion, said barrel portion being constructed solely of a polymer composite material, said polymer composite material comprising a resin and reinforcement fibers, said reinforcement fibers comprising two or more three-dimensional fiber forms oriented on two or more concentric cylindrical planes defined by said length and said circumference, and wherein alternate ones of said two or more concentrically oriented cylindrical planes of said three-dimensional fiber forms are selected from the group of three-dimensional fiber forms consisting of chopped strand mat and continuous strand mat, or mixtures thereof.

33. A baseball bat, having a length, and a circumference, comprising:

a cylindrical handle portion for gripping;

a cylindrical tubular barrel portion for striking; and, a tapered cylindrical mid-section connecting said handle portion and said barrel portion, said barrel portion being constructed solely of a polymer composite material, said polymer composite material comprising a resin and reinforcement fibers, said reinforcement fibers comprised of at least between 85% and 100% fiberglass fibers, wherein said reinforcement fibers are oriented on two or more concentric cylindrical planes defined by said length and said circumference, and wherein alternate ones of said two or more cylindrically oriented cylindrical planes of said reinforcement fibers are selected from the group of three-dimensional fiber forms consisting of chopped strand mat and continuous strand mat, or mixtures thereof.

34. A tubular baseball bat, having a length, a circumference, a wall thickness and a central cavity, comprising:

a cylindrical handle portion for gripping;

a cylindrical barrel portion for striking; and, a tapered cylindrical mid-section connecting said handle portion and said barrel portion, said handle portion, said barrel portion and said tapered mid-section being constructed solely of a polymer composite material, said polymer composite material comprising a resin and reinforcement fibers, said reinforcement fibers oriented on at least two concentric cylindrical planes defined by said length and said circumference, said reinforcement fibers in alternate ones of said at least two concentric cylindrical planes further oriented to intersect said corresponding cylindrical plane through the wall thickness of the bat, wherein said alternate ones of said at least two concentrically oriented planes of said reinforcement fibers are selected from the group of three-dimensional fiber forms consisting of chopped strand mat and continuous strand mat, or mixtures thereof.

35. A tubular baseball bat, having a length, a circumference, a wall thickness and a central cavity, comprising:

a cylindrical handle portion for gripping;

a cylindrical barrel portion for striking; and, a tapered cylindrical mid-section connecting said handle portion and said barrel portion, said handle portion, said barrel portion, and said tapered mid-section being constructed solely of a polymer composite material, said polymer composite material comprising a resin and reinforcement fibers, said reinforcement fibers comprising two or more three-dimensional fiber forms oriented on two or more concentric cylindrical planes defined by said length and said circumference, and wherein alternate ones of said two or more concentrically oriented cylindrical planes of said three-dimensional fiber forms are selected from the group of three-dimensional fiber forms consisting of chopped strand mat and continuous strand mat, or mixtures thereof.

* * * * *